US006082145A

United States Patent [19]

Lonati et al.

[11] Patent Number: 6,082,145

[45] Date of Patent: Jul. 4, 2000

[54] METHOD FOR MANUFACTURING KNITTED ITEMS WITH A PASSAGE FOR THE INSERTION OF SUPPORT ELEMENTS, AND ITEM OBTAINED WITH THE METHOD

[75] Inventors: Francesco Lonati; Ettore Lonati; Fausto Lonati; Tiberio Lonati, all of Brescia, Italy

[73] Assignee: Santoni S.p.A., Brescia, Italy

[21] Appl. No.: 09/090,565

[22] Filed: Jun. 8, 1998

[30] Foreign Application Priority Data

Jun. 25, 1997 [IT] Italy ..... MI97A1503

[51] Int. Cl.[7] ..... D04B 1/24

[52] U.S. Cl. ..... 66/176; 66/170; 66/190

[58] Field of Search ..... 66/169 R, 170, 66/171, 172 R, 173–190, 172 E, 21–22, 23, 176

[56] References Cited

U.S. PATENT DOCUMENTS

| | | | |
|---|---|---|---|
| 2,584,834 | 2/1952 | Bevins et al. . | |
| 2,966,785 | 1/1961 | Goff et al. | 66/176 |
| 3,500,665 | 3/1970 | Braxton et al. | 66/176 |
| 3,537,279 | 11/1970 | Epley | 66/176 |
| 3,772,899 | 11/1973 | Novi | 66/176 |
| 3,789,098 | 1/1974 | Cole et al. | 264/103 |
| 5,472,366 | 12/1995 | More . | |
| 5,592,836 | 1/1997 | Schuster et al. | 66/176 |
| 5,669,247 | 9/1997 | McCartney et al. | 66/195 |

FOREIGN PATENT DOCUMENTS

| | | |
|---|---|---|
| 0132087 | 1/1985 | European Pat. Off. . |
| 735907 | 11/1932 | France . |
| 2647816 | 12/1990 | France . |

*Primary Examiner*—Danny Worrell

*Attorney, Agent, or Firm*—Guido Modiano; Albert Josif; Daniel O'Byrne

[57] ABSTRACT

A method for manufacturing knitted items, particularly for manufacturing items of underwear, with a passage for the insertion of support wires or other insertion elements, in circular knitting machines, and an item obtained with the method. The method consists in forming the passage for the insertion of the wire or other insertion element in an intermediate production step during the knitting of the item, by knitting additional row portions with a preset number of needles alternated with needles excluded from knitting during the formation of the additional rows. In this manner, on one side of the item, a tunnel is obtained which is part of the item and inside which it is possible to insert a support wire or other insertion elements.

6 Claims, 2 Drawing Sheets

METHOD FOR MANUFACTURING KNITTED ITEMS WITH A PASSAGE FOR THE INSERTION OF SUPPORT ELEMENTS, AND ITEM OBTAINED WITH THE METHOD

BACKGROUND OF THE INVENTION

The present invention relates to a method for manufacturing knitted items, particularly for manufacturing items of underwear, with a passage for the insertion of support wires or other insertion elements, in circular knitting machines for stocking or hosiery-making, and to an item obtained with said method.

Support wires or other insertion elements are conventionally used in underwear, for example in bodies and brassieres but also sometimes in underpants and vests, with functional or purely decorative purposes. Such elements are inserted in specifically provided pockets or tunnel-shaped passages formed in the item by applying, usually on the back of the item, sewn fabric tapes or suitable seams after the manufacture of the item, which is performed by means of circular knitting machines.

Clearly, the provision of the seams or the application of tapes to form the pockets or tunnel-shaped passages for the insertion of wires, tapes or other, entails additional work which affects the production cost of these items.

Moreover, the presence of tapes applied on the back of the item can cause discomfort to the user, in view of the fact that these items of underclothing are worn directly in contact with the skin.

SUMMARY OF THE INVENTION

The aim of the present invention is to solve the above problem by providing a method which allows to manufacture knitted items, particularly items of underwear, wherein the passage for the insertion of the support wires or other insertion elements is provided directly in the circular knitting or hosiery-making machine used to manufacture the item, so as to provide an item which does not require additional work to provide said passage.

Within the scope of this aim, an object of the present invention is to provide a method which can be performed easily in modern circular knitting or hosiery-making machines by simply preparing a suitable program for the actuation of the machine.

Another object of the present invention is to provide a method which, by providing the passage for the insertion of support wires or other insertion elements directly on the item, practically eliminates user discomfort caused by the presence, on the back of the item, of seams or applied tapes.

This aim, these objects and others which will become apparent hereinafter are achieved by a method for manufacturing knitted items, particularly for manufacturing items of underwear, with a passage for the insertion of support wires or other insertion elements, in circular knitting or hosiery-making machines, characterized in that the passage for the insertion of the wire or other insertion element is formed, in an intermediate production step during the knitting of the item, by knitting additional row portions with a preset number of needles which are alternated with needles excluded from knitting during the formation of said additional rows.

BRIEF DESCRIPTION OF THE DRAWINGS

Further characteristics and advantages of the present invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

Figure 2:
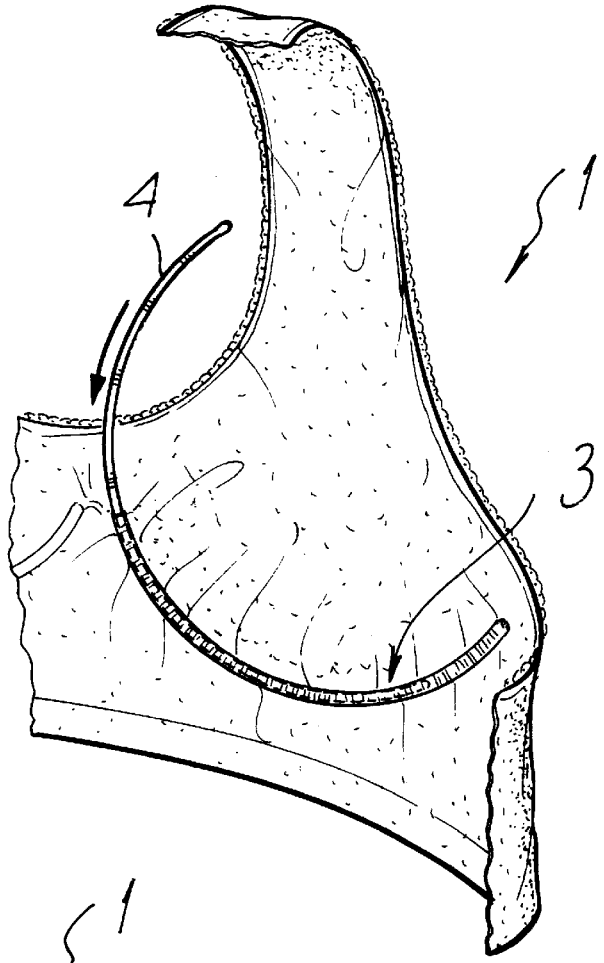
FIG. 2 illustrates the insertion of a wire in the passage formed on the back of the item shown in FIG. 1.
Figure 1:
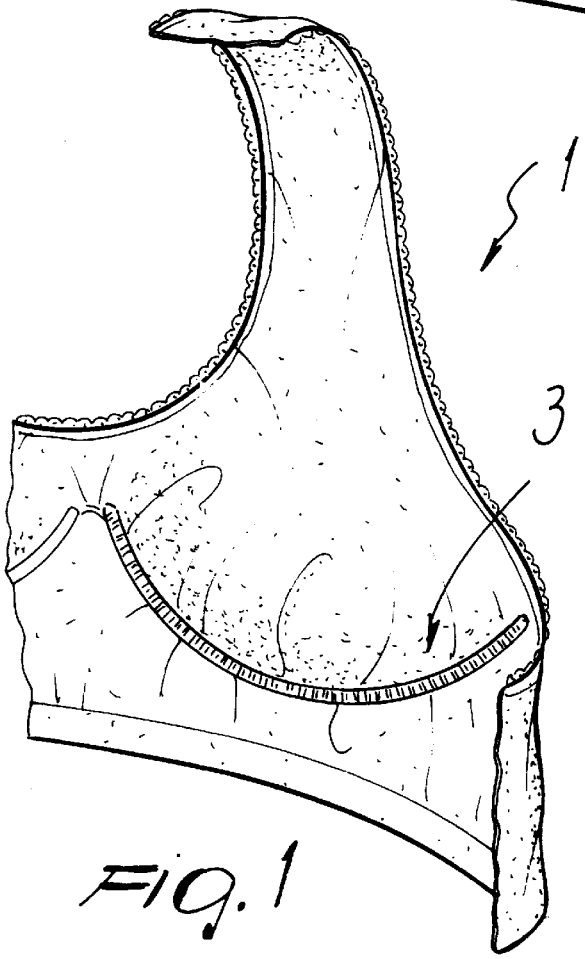
FIG. 1 is a view of the back of an item produced with the method according to the present invention.
Figure 3:
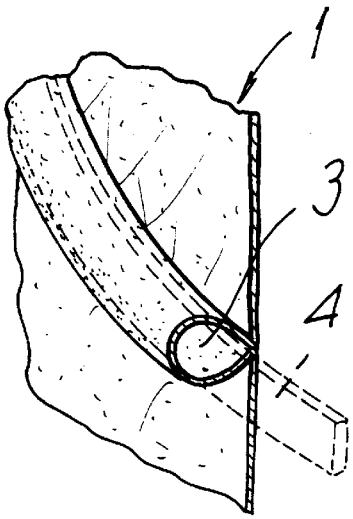
FIG. 3 is an enlarged-scale view of a detail of the item, illustrating the passage for the insertion of the wire.

With reference to the above figures, the method according to the present invention substantially consists in the formation of the passage for the wire or other insertion element during the knitting of the item, generally designated by the reference numeral 1, in an intermediate step of the manufacture of said item, by knitting additional knitting row portions 2 by means of a preset number of needles which are alternated with needles excluded from knitting during the formation of said additional rows 2.

The item according to the invention is produced, except for the region at which the passage 3 for the wire 4 or other element is formed, in a manner substantially similar to the production of conventional items.

Figure 4:
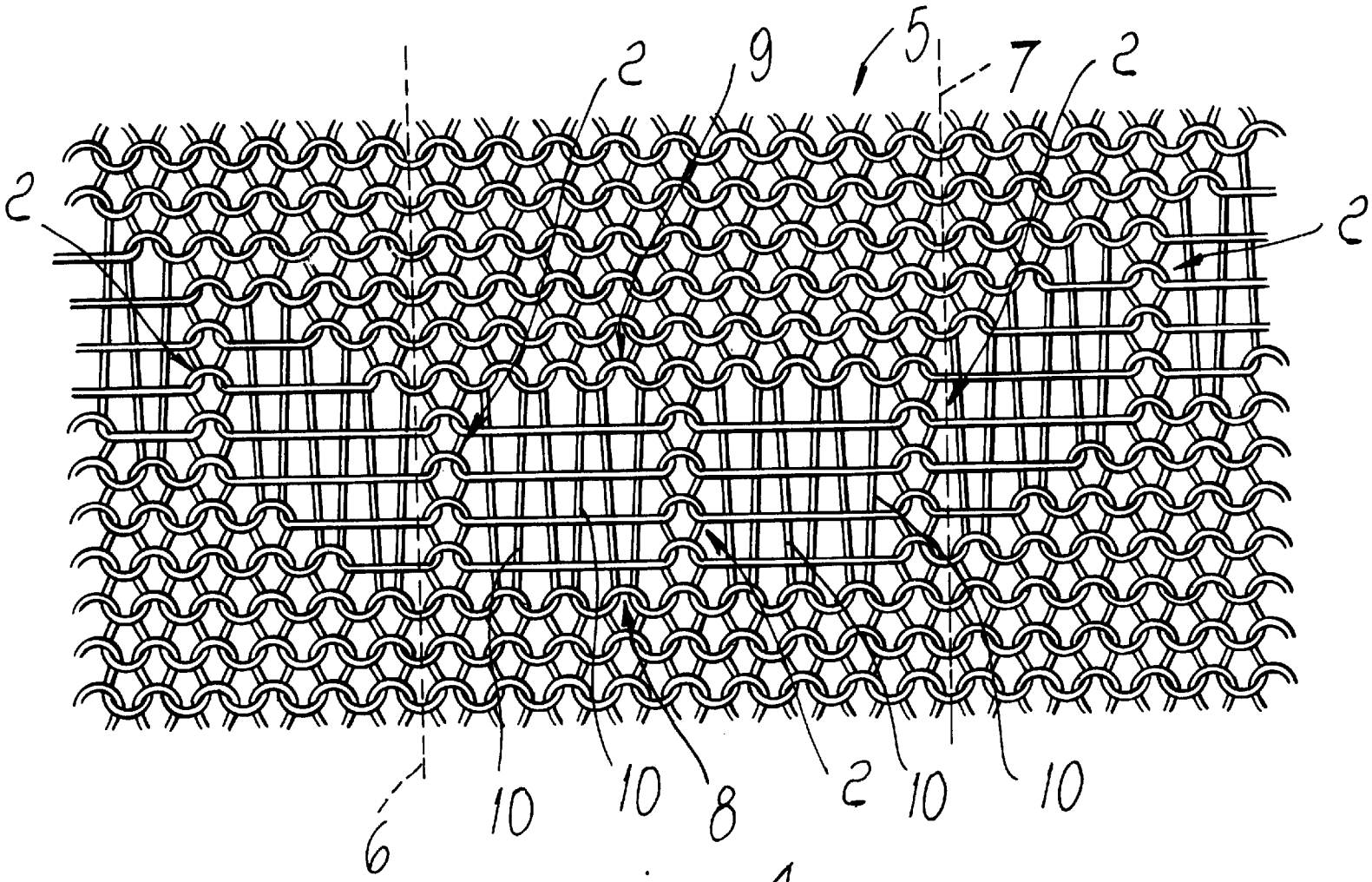
FIG. 4 is an enlarged-scale view of a portion of the knitting that forms the item at the passage for the wire, with the mesh stretched to clearly show the loops of knitting at the wire passage.

More particularly, it is considered a set of needles of the needle cylinder of a circular knitting machine, meant to form a strip 5 of the item, delimited by the dashed lines 6 and 7 in FIG. 4, which runs perpendicularly to the rows of knitting and is affected by the formation of the passage 3. Before beginning the intermediate production step during which the passage 3 is formed, the needles of said set of needles are all made operative to knit, so as to take up the yarn or yarns fed at a feed of the machine, forming a portion 8 of a row of knitting which is substantially complete except for particular pattern effects, if any.

At the beginning of the intermediate production step, during which the passage 3 is formed, a preset number of needles, which belong to said set, alternated with needles excluded from knitting, is actuated, at the subsequent yarn feeds and for a preset number of feeds, so as to form the additional row portions 2, while the other needles are excluded from knitting. In knitting the strip 5 shown in FIG. 4, three needles knit additional rows 2, while the other needles of the set are excluded from knitting during the formation of said additional rows 2, retaining the last formed loop of knitting.

At the end of said intermediate production step, the needles of the above-mentioned set of needles are again all made to knit, so as to take up the thread or threads fed at a subsequent feed of the machine, again forming a portion of a complete row of knitting 9 which is meshed in with the loops previously retained by the needles excluded from knitting during the intermediate production step and with the last loops of the additional row portions 2 knit by the preset number of needles.

In practice, the preset number of needles actuated during the intermediate production step forms extra portions of rows of knitting with respect to the rows formed by the needles excluded from knitting during the intermediate production step.

The excess row portions formed by the preset number of needles made to knit during the intermediate production step determines, on one side of the item, an excess of mesh which is tubular in shape and constitutes the passage 3 inside which the wire 4 or other insertion element will be inserted.

In FIG. 4, in order to show the method more clearly, the mesh of the item has been shown in a stretched condition, assuming that the item is manufactured with elastic yarns. As clearly shown, the loops of the last portion of row of knitting 8 formed by the needles that are then excluded from knitting during the intermediate production step are meshed in with the loops of the first row portion 9 formed after the end of the intermediate production step; likewise, the last loops of the additional row portions 2 are meshed in with said loops. When the item is not stretched, the loops of knitting 10 that protrude from the last row portion 8 formed by using all the needles of the above set of needles and the row portion 9 become shorter, moving closer to each other the loops of the portion of row of knitting 8 formed before the intermediate production step and the loops formed during the production of the first row portion 9 after said intermediate production step. Due to this approach, the additional row portions 2 protrude, assuming a tubular arrangement, on one side of the item, preferably on the back, forming the passage 3 inside which the wire 4 or other insertion element is then inserted.

It should be noted that the number of needles that form the additional row portions during the intermediate production step, with respect to the needles excluded from knitting during said intermediate production step, may vary according to requirements. The selection of the needles that must form the additional row portions 2 and the exclusion of the other needles from knitting during the intermediate production step can be performed through the selection devices with which modern knitting machines for hosiery-making are usually provided.

If a curved shape is required for the passage 3 under the cups of the brassiere, as usually occurs in the production of items such as brassieres or bodies, the beginning and the end of the additional row portions are offset row by row for sets of contiguous needles, as shown in particular in FIG. 4.

Preferably, the item is knitted by using elastically extendable threads.

In practice, the knitted item obtained with the method according to the present invention has a passage 3 for the insertion of supporting wires 4 or other insertion elements formed by portions of rows of knitting in excess on some longitudinal rows of knitting, alternated with longitudinal rows of knitting not affected by said excess of rows.

In this manner, an item is obtained which has, at the end of its production, a passage 3 on one of its sides inside which it is possible to easily insert the supporting wire 4 or other insertion elements without requiring any additional work.

In practice it has been observed that the method according to the invention fully achieves the intended aim and objects, since it allows to form knitted items wherein the passage or pockets for the insertion of supporting wires or other insertion elements is formed directly in the body of the item without requiring the application of tapes or the provision of particular seams on the back of the item in order to form said passage.

The method according to the present invention has been conceived particularly for manufacturing knitted items with a passage meant to accommodate supporting wires, but it can also be used to provide items with passages or pockets meant to accommodate other insertion elements, such as for example tapes for tensioning the item, supporting or containment whalebone type inserts or other such elements. The passage for said elements, according to requirements, may be provided on the right side or on the back of the item.

Although the method according to the invention has been described and illustrated with particular reference to the provision of an item of the brassiere type, it can be used in any case to produce other items, such as for example vests, underpants, bodies and swimming costumes, without thereby abandoning the scope of the protection of the present invention.

The method thus conceived is susceptible of numerous modifications and variations, all of which are within the scope of the inventive concept; all the details may also be replaced with other technically equivalent elements.

In practice, the materials used, as well as the dimensions, may be any according to the requirements and the state of the art.

What is claimed is:

1. A method for manufacturing knitted items, with a passage for the insertion of an insertion element, in circular knitting machines having selectively actuatable needles and yarn feeds, the method comprising: an intermediate production step during the knitting of the item in which the insertion passage is formed, said intermediate steps including forming additional row portions of knitting with a preset number of operative needles, said operative needles being alternated in position with needles excluded from knitting during the forming of said additional row portions, said additional row portions defining bridges which create said passage for the insertion of an insertion element.

2. The method of claim 1, wherein during the forming of a last row of knitting before said intermediate production step, at least one set of contiguous needles of the machine is made operative to knit so as to take up yarn or yarns fed at a feed of the machine, for forming a portion of a complete row of knitting; and wherein during said intermediate production step, only a preset number of needles of said needle set is made operative to knit, with the operative needles being alternated with needles which are excluded from knitting, in order to take up the yarn or yarns fed for a preset number of feeds, at subsequent feeds, to form said additional row portions, while said needles excluded from knitting retain a last formed loop of knitting; and wherein at the end of said intermediate production step, the needles of said set of needles being made operative to knit for taking up the yarn or yarns fed at a feed of the machine, again form a portion of a complete row of knitting which is meshed in with the loop retained by the needles excluded from knitting during said intermediate production step and with a last loop of said additional row portions knitted by said preset number of needles.

3. The method of claim 2, wherein beginnings and ends of said additional row portions are knitted offset row by row for sets of contiguous needles to produce a curved path of said passage along the item.

4. A knitted item obtained by the method of claim 1, particularly an item of underwear, with a passage for the insertion of an insertion element, comprising, on selected longitudinal knitting rows, portions of excess knitting rows alternated with conventionally formed longitudinal knitting rows.

5. The item of claim 4, wherein said passage defines curved path along an item surface.

6. The item of claim 4, wherein at least said excess knitting row portions are formed with elastic yarn.

* * * * *